US005775748A

United States Patent [19]

Kurachi

[11] Patent Number: 5,775,748

[45] Date of Patent: Jul. 7, 1998

[54] LATCH DEVICE

[75] Inventor: Katsuhito Kurachi, Aichi-ken, Japan

[73] Assignee: Nifco Inc., Kanagawa, Japan

[21] Appl. No.: 587,839

[22] Filed: Jan. 11, 1996

[30] Foreign Application Priority Data

Jan. 17, 1995 [JP] Japan ..... 7-005120

[51] Int. Cl.[6] ..... E05B 15/02

[52] U.S. Cl. ..... 292/341.15; 292/57; 292/DIG. 4

[58] Field of Search ..... 292/341.15, 341.17, 292/DIG. 37, DIG. 38, DIG. 49, 57, 124, 125, DIG. 4, 6

[56] References Cited

U.S. PATENT DOCUMENTS

| | | | |
|---|---|---|---|
| 4,616,861 | 10/1986 | Kurosaki | 292/6 |
| 4,655,489 | 4/1987 | Bisbing | 292/110 |
| 4,657,291 | 4/1987 | Kurosaki | 292/6 |
| 4,660,871 | 4/1987 | Arakawa et al. | 292/81 |
| 4,687,237 | 8/1987 | Bisbing | 292/78 |
| 4,688,834 | 8/1987 | Nakayama | 292/5 |
| 4,709,949 | 12/1987 | Umezawa | 292/6 |
| 4,779,906 | 10/1988 | Kurosaki | 292/19 |
| 4,792,165 | 12/1988 | Nishimura | 292/19 |
| 5,090,751 | 2/1992 | Kobayashi | 292/71 |
| 5,217,262 | 6/1993 | Kurosaki | 292/6 |
| 5,273,328 | 12/1993 | Kurosaki | 292/336.3 |
| 5,292,158 | 3/1994 | Kurosaki | 292/45 |
| 5,401,067 | 3/1995 | Kurosaki et al. | 292/63 |

FOREIGN PATENT DOCUMENTS

| | | |
|---|---|---|
| 4-213679 | 8/1992 | Japan . |
| 4-213680 | 8/1992 | Japan . |
| 5-340152 | 12/1993 | Japan . |
| 941444 | 12/1995 | Japan . |

*Primary Examiner*—Steven M. Meyers
*Assistant Examiner*—Gary Estremsky
*Attorney, Agent, or Firm*—Cowan, Liebowitz & Latman, P.C.

[57] ABSTRACT

A latch device in which joggling of a latch main body is prevented and smooth movement of the latch main body is realized. When the latch main body is pushed-in from a first position of an insertion direction of the latch main body, holding of the first position is cancelled. Due to a spring, a stopper moves in a guide hole and abuts an end of the guide hole and the latch main body reaches a second position at a side opposite an insertion side. If the latch main body is pushed-in from the second position, the latch main body returns to the first position. When the latch main body is pushed-in to the first position and moves, an abutting portion extending from the stopper to a latch main body insertion side slides along an inner surface of a case wall, in a direction in which the stopper fits into the guide hole, along a side edge of the guide hole at a region at which the abutting portion misses the guide hole. In this way, when the latch main body moves from the second position to the first position, the latch main body is prevented from entering into the guide hole.

10 Claims, 6 Drawing Sheets

LATCH DEVICE

BACKGROUND OF THE INVENTION

1. Field of the Invention

The present invention relates to a latch device in which each time a latch main body, which is inserted into a case, is pushed-in in an insertion direction, a first position in the insertion direction and a second position in the direction opposite to the insertion direction are obtained alternately.

2. Description of the Related Art

A known example of such a latch device which is used to open and close the cover of an audio device or the like will be described hereinafter. As illustrated in FIG. 10, a rectangular box shaped latch main body 102 is inserted within a case 104 and moves freely along the insertion direction (in the direction of the arrow marked IN in the figure). The latch main body 102 includes a tube portion 106, whose axial direction is the moving direction of the latch main body 102, and a plate-shaped portion 108, which stands upright from the tube portion 106 and extends along the moving direction of the latch main body 102.

A stopper 110 projects at the side edge portion of the plate-shaped portion 108 of the latch main body 102 at the end portion in the direction opposite the insertion direction of the latch main body 102 (i.e., at the end portion in the pulling-out direction of the latch main body 102). A guide hole 114 with which the stopper 110 fits is formed in a case wall 112 of the case 104 opposing the stopper 110. The guide hole 114 is formed to be elongated along the insertion direction of the latch main body 102. As the latch main body 102 moves, the stopper 110 moves along the longitudinal direction of the guide hole 114. Due to the latch main body insertion direction end surface of the tube portion 106 abutting the latch main body insertion direction end wall of the case 104 (the case deep wall), further movement of the latch main body 102 in the insertion direction is prevented. Further, due to the stopper 110 abutting a longitudinal direction end of the guide hole 114 in the pulling-out direction of the latch main body, further movement of the latch main body 102 in the direction opposite the insertion direction is prevented.

A projecting rod 116 projects from the case deep wall so as to be insertable into the tube portion 106. A coil spring 118 is fit on the peripheral portion of the projecting rod 116, and is accommodated within the tube portion 106. The coil spring 118 urges the latch main body 102 in the pulling-out direction.

A cam 120 is provided on each side surface of the plate-shaped portion 108 (only one cam is illustrated in the figure). The distal ends of a U-shaped lever 122 extending from the case deep wall are bent to face each other and engage cam grooves formed around the cams 120.

As the latch main body 102 moves, the distal ends of the lever 122 engage the cam grooves and move. Therefore, each time the latch main body 102 is pushed-in, the following occur alternately: the distal ends of the lever 122 engage concave portions 124 of the cams 120 so that the latch main body 102 is held at a first position at an insertion direction side, and the engagement of the distal ends of the lever 122 and the concave portions 124 of the cams 120 is cancelled such that the holding of the first position is released and the latch main body 102 is pushed by the coil spring 118 so as to be positioned at a second position.

As illustrated in FIGS. 10 and 2, a hook 126 is provided via a flexible member 128 at the side of the latch main body 102 in the direction opposite the insertion direction. The hook 126 freely inclines around the flexible plate 128 such that the inclination thereof differs at the first position and the second position of the latch main body 102. The latch device is provided at the main body of an audio device or the like, and a striker (unillustrated) corresponding to the hook 126 is provided at a cover. When the cover is to be closed, if the latch main body 102 is pushed-in to the insertion direction side via a pushed portion 130 of the hook 126, the hook 126 is pushed by an insertion opening end 132 of the case 104 and the inclination thereof is changed so that the hook 126 enters into the case 104 (i.e., the hook 126 inclines in the direction of arrow A in FIG. 10 so as to assume the state illustrated by the chain line). A reaching portion 134 which reaches the end portion of the coil spring 118 projects from the pushed portion 130 of the hook 126, and the hook 126 receives rotational urging force (in the direction opposite to arrow A) due to the urging force of the coil spring 118. When the latch main body 102 is held in the first position, the striker engages the interior of a concave portion 136 of the hook 126, and the engaged state is maintained. If the cover is pushed, the latch main body 102 is pushed-in via the pushed portion 130 of the hook 126, the holding of the first position is cancelled, and the latch main body 102 moves to the second position. In accordance with this movement, the hook 126 urged by the coil spring 118 returns and inclines, the engagement of the striker and the concave portion 136 of the hook 126 is cancelled at the second position, and opening of the cover is possible.

As shown in FIG. 10, the thickness of the plate-shaped member 108 extending from the stopper 110 to the insertion side of the latch main body 102 is the same thickness as the stopper 110. As a result, when the latch main body 102 moves from the second position to the first position, the plate-shaped portion 108 of the latch main body 102 enters into the guide hole 114, and the latch main body 102 joggles so that operation is not smooth.

Further, because the inclinations of the hook 126 must be different, when the pushed portion 130 of the hook 126 is pushed-in to move the latch main body 102 from the second position to the first position, the hook 126 receives rotational urging force (in the direction opposite to arrow A) due to the urging force of the coil spring 118. As the latch main body 102 is pushed-in, urging force which urges the insertion direction side of the plate-shaped portion 108 to exit to the exterior through the guide hole 114 acts on the latch main body 102. The latch main body 102 enters the guide hole 114 more easily.

SUMMARY OF THE INVENTION

In view of the aforementioned, an object of the present invention is to provide a latch device which prevents joggling of a latch main body and which realizes smooth movement of the latch main body.

The present invention provides a latch device comprising: a case formed by a case wall; a latch main body inserted into the case, and moving freely along a direction of insertion of the latch main body into the case; an urging member provided between the case and the latch main body, and urging the latch main body in a direction opposite to the direction of insertion; an operation member provided between the case and the latch main body, and operating each time the latch main body is pushed-in in the direction of insertion so as to alternately hold the latch main body at a first position at a direction of insertion side and cancel holding of the latch main body at the first position; a guide hole provided in the case wall of the case along a moving direction of the latch main body; a stopper formed to project from the latch main body, and fitting within the guide hole, and moving within the guide hole in accordance with movement of the latch main body, and due to the stopper abutting one end of the guide hole, movement of the latch main body in the direction opposite to the direction of insertion is prevented at a second position at a side in a direction opposite the direction of insertion of the latch main body; and an abutting portion abutting an inner surface of the case wall in a vicinity of the guide hole in a direction in which the stopper fits into the guide hole, the abutting portion being formed at the latch main body along the moving direction of the latch main body from a side of the stopper to an insertion side of the latch main body.

In accordance with the above-described structure, by pushing the latch main body into the case in the direction of insertion, the latch main body is held at the first position of the direction of insertion. By pushing the latch main body in again, the holding of the latch main body at the first position is cancelled, and the latch main body moves to the second position due to the urging force of the urging member. As the latch main body moves to the second position, the stopper moves into the guide hole, and the second position of the latch main body is held by the stopper abutting one end of the guide hole. By pushing the latch main body in again, the latch main body moves to the first position, and the first position is maintained.

When the latch main body moves to the first position, the abutting portion extending from the side of the stopper to the insertion side abuts and slides along the inner surface of the case wall in a vicinity of the guide hole in the direction in which the stopper fits into the guide hole.

Accordingly, when the latch main body moves from the second position to the first position, entry of the latch main body into the guide hole is prevented. Joggling which results from the latch main body entering into the guide hole is prevented, and smooth movement of the latch main body, i.e., smooth latch operation, is realized.

The above and other objects, features and advantages of the present invention will become apparent from the following description and the appended claims, taken in conjunction with the accompanying drawings in which a preferred embodiment of the present invention is shown by way of illustrative example.

BRIEF DESCRIPTION OF THE DRAWINGS

The invention will now be described with reference to the accompanying drawings wherein.

DESCRIPTION OF THE PREFERRED EMBODIMENT

Figure 1:
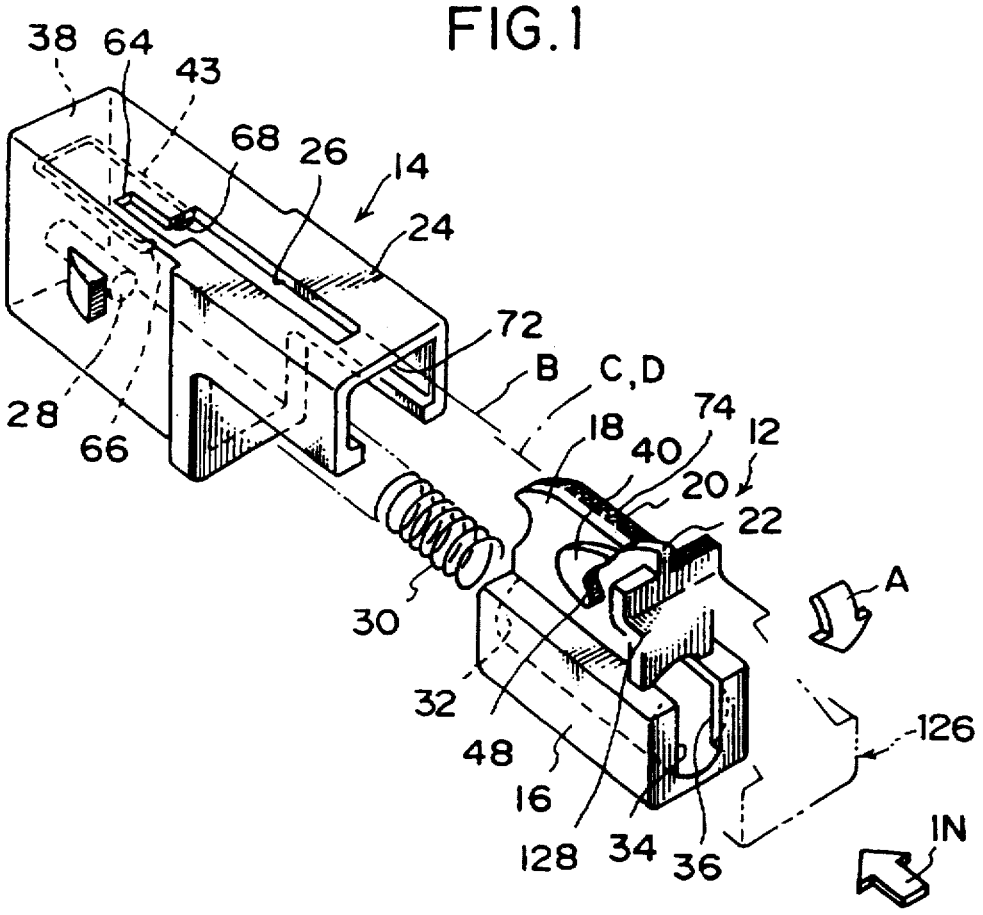
FIG. 1 is an exploded perspective view illustrating an embodiment of a latch device of the present invention.

Hereinafter, an embodiment of a latch device relating to the present invention will be described on the basis of FIGS. 1 through 9. As illustrated in FIGS. 1 through 5, a rectangular box shaped latch main body 12 is inserted within a case 14 and moves freely along the insertion direction (denoted by the arrow IN). The latch main body 12 has a tube portion 16, whose axial direction is the direction of movement of the latch main body 12, and a plate-shaped portion 18 which stands upright from the tube portion 16 and extends along the insertion direction of the latch main body 12.

A stopper 22 projects from a side edge portion 20 of the plate-shaped portion 18 at the side opposite the latch main body insertion side. A guide hole 26 is formed in a case wall 24 of the case 14 opposing the stopper 22. The guide hole 26 is formed so as to be elongated along the insertion direction of the latch main body. The stopper 22 fits into the guide hole 26 and as the latch main body 12 moves, the stopper 22 moves in the guide hole 26 along the longitudinal direction thereof. Due to the tube portion 16 abutting a latch main body insertion direction side end wall 38 of the case 14 (i.e., the case deep wall), further movement of the latch main body 12 in the insertion direction is prevented. Further, due to the stopper 22 abutting the longitudinal direction end of the guide hole 26 at the opposite side of the latch main body insertion direction side, further movement of the latch main body 12 toward the opposite side of the insertion direction side (i.e., further movement of the latch main body 12 in the direction opposite to arrow IN) is prevented. The position at which movement toward the side opposite the insertion direction side is prevented is the second position illustrated in FIGS. 5 and 7.

A projecting rod 28 projects coaxially with the tube portion 16 from the latch main body insertion direction side end wall of the case 14 (the case deep wall 38), so as to be insertable into the tube portion 16. A coil spring (urging member) 30 is fit on the peripheral portion of the projecting rod 28, and is accommodated within the tube portion 16. The tube interior of the tube portion 16 is formed as a circular hole 32 except for the end portion at the side opposite the latch main body insertion side. This end portion is formed with a rectangular hole 34 to form a step portion 36 which closes a portion of the circular hole 32. One end of the coil spring 30 abuts the case deep wall 38, whereas the other end abuts the step portion 36. The coil spring 30 urges the latch main body 12 in the direction opposite to the insertion direction.

A first cam 40 and a second cam 42 project from side surfaces of the plate-shaped portion 18. Cam grooves or cam surfaces are formed at the peripheries of the first cam 40 and the second cam 42. A U-shaped lever 43 (which together with the cams forms the operation member) is provided so as to correspond to the cam grooves. The intermediate portion of the lever 43 is supported at the case deep wall 38 so as to rotate freely. The distal ends of the lever 43 form a first engaging portion 66 and a second engaging portion 68 which extend from the case deep wall 38 in the direction opposite the latch main body insertion direction, are bent to face each other in such a manner as to nip the plate-shaped portion 18, and engage the cam grooves. The lever 43 is elastically deformable.

Figure 3:
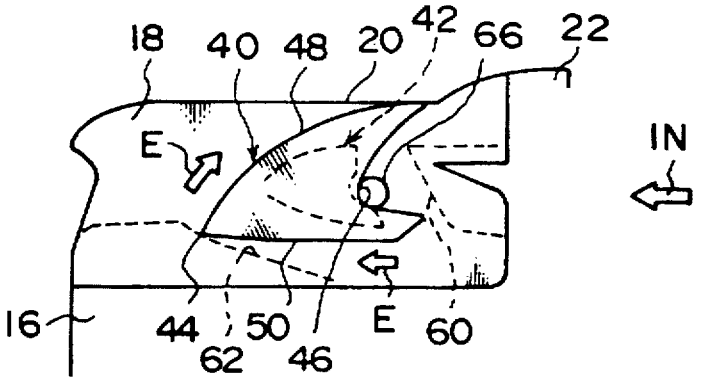
FIG. 3 is a view illustrating one of cam grooves of the latch main body.

As illustrated in FIG. 3, the first cam 40 is heart-shaped. A peak portion 44 of the first cam 40 is positioned at the latch main body insertion side, and a concave portion 46 of the first cam 40 is positioned at the side opposite to the latch main body insertion side. A pair of intermediate portions 48, 50 are formed between the concave portion 46 and the peak portion 44.

Figure 4:
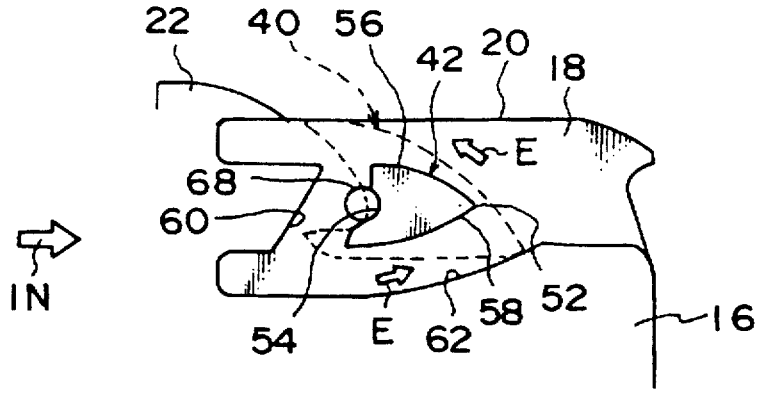
FIG. 4 is a view illustrating the other of the cam grooves of the latch main body.

Similarly to the first cam 40, the second cam 42 is heart-shaped as illustrated in FIG. 4. However, the second cam 42 is smaller than the first cam 40, with the outline of the second cam 42 being within the outline of the first cam 40. Further, the configurations of the first cam 40 and the second cam 42 are actually slightly different.

When the latch main body 12 is pushed-in from the second position, the first engaging portion 66 moves toward the concave portion 46 along the intermediate portion 48 of the first cam 40. Then, the first engaging portion 66 is pushed at the edge of an opening 64 formed in the case wall 24 and moves from the intermediate portion 48 into the concave portion 46, at some time before the time that the end surface of the tube portion 16 at the latch main body insertion side abuts the case deep wall 38 and further movement of the latch main body 12 in the insertion direction is prevented. In this state, when the pushing-in of the latch main body 12 is stopped, the latch main body 12 moves slightly toward the side opposite the insertion direction. The first engaging portion 66 engages with the concave portion 46, and the second engaging portion 68 engages with the concave portion 54 of the second cam 42, so that the latch main body 12 assumes the first position illustrated in FIGS. 6 and 8. In the first position, movement of the latch main body 12 in the direction opposite the insertion direction is prevented.

When the latch main body 12 is pushed-in in the insertion direction from the first position, at some time before the time that the latch main body insertion side end surface of the tube portion 16 abuts the case deep wall 38 and further movement of the latch main body 12 in the insertion direction is prevented, the second engaging portion 68 is pushed by a guide portion 60 opposing the concave portion 54, thereby generating torsion between the second engaging portion 68 and the first engaging portion 66. Due to the restoring deforming force of the lever 43 which is caused by the torsion, the first engaging portion 66 comes out from the concave portion 46 at the other intermediate portion 50 and the second engaging portion 68 comes out from the concave portion 54 at the other intermediate portion 58. In this state, when pushing-in of the latch main body 12 is stopped, the latch main body 12 moves to the second position due to the urging force of the coil spring 30. As the latch main body 12 moves to the second position, the first engaging portion 66 moves along the intermediate portion 50 toward the peak portion 44. Then, before the latch main body 12 reaches the second position, the second engaging portion 68 is pushed by a guide portion 62 opposing the intermediate portion 58 thereby generating torsion between the second engaging portion 68 and the first engaging portion 66. Due to the restoring deforming force of the lever 43 which is caused by the torsion, the first engaging portion 66 slides off of the intermediate portion 50 and onto the intermediate portion 48. The intermediate portion 56 of the second cam 42 is further inward than the intermediate portion 48 of the first cam 40. Therefore, when the latch main body 12 is pushed-in from the second position, the second engaging portion 68 can proceed toward the one intermediate portion 56 without returning toward the other intermediate portion 58. The first engaging portion 66 and the second engaging portion 68 move annularly around the respectively corresponding cams in the direction of arrow E relatively to the latch main body 12.

In this way, each time the latch main body 12 is pushed-in, holding of the first position of the latch main body and operation for cancelling the holding of the latch main body are achieved alternately.

Figure 2:
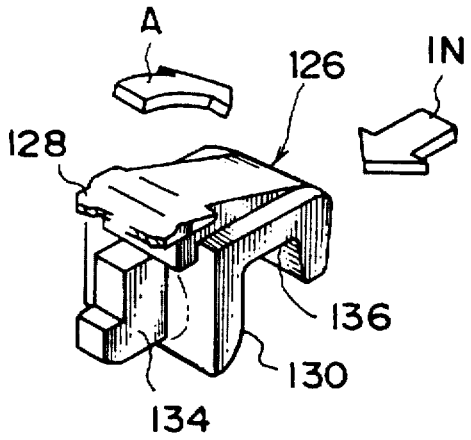
FIG. 2 is a perspective view of a hook of a latch main body as viewed from the opposite side of FIG. 1.
Figure 5:
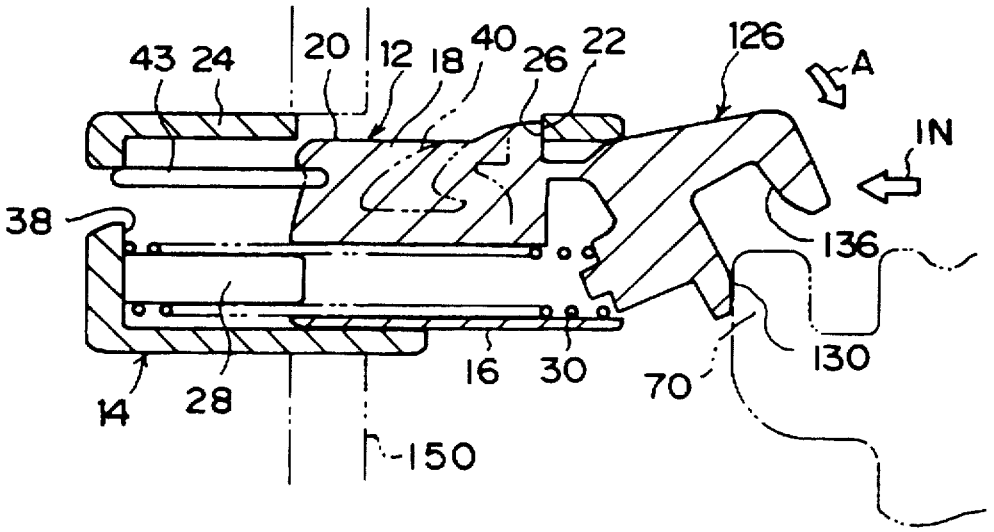
FIG. 5 is a cross-sectional view cut along a direction of insertion of the latch main body and illustrating a second position of the latch main body.
Figure 6:
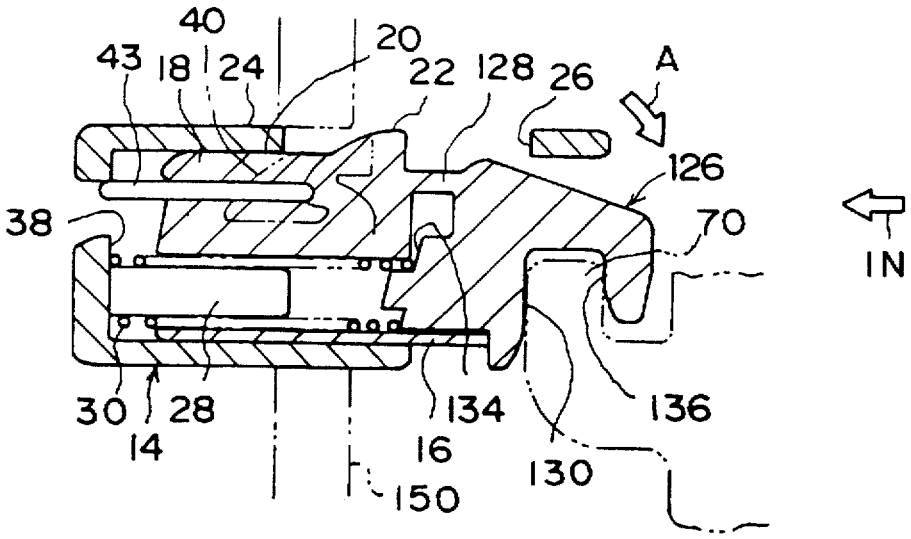
FIG. 6 is a view corresponding to FIG. 5 and illustrating a first position of the latch main body.
Figure 7:
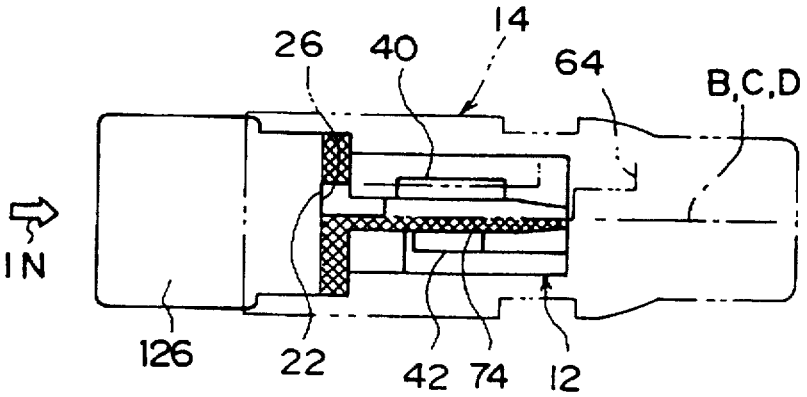
FIG. 7 is a view seen from a direction in which a stopper of the latch main body is fit in a guide hole of a case, and illustrating a relationship between the stopper and the guide hole in the second position of the latch main body.
Figure 8:
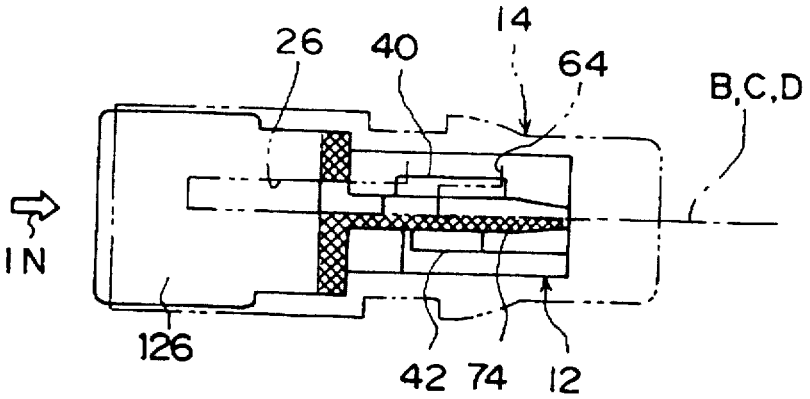
FIG. 8 is a view corresponding to FIG. 7 in the first position of the latch main body.
Figure 9:
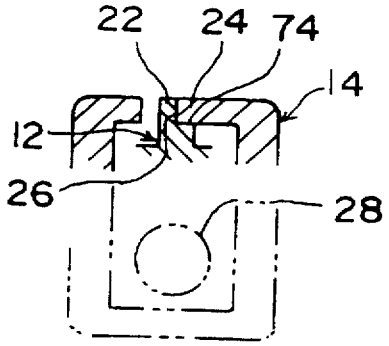
FIG. 9 is a view seen from a direction of movement of the latch main body and illustrating a relationship between the stopper of the latch main body and the guide hole of the case.
Figure 10:
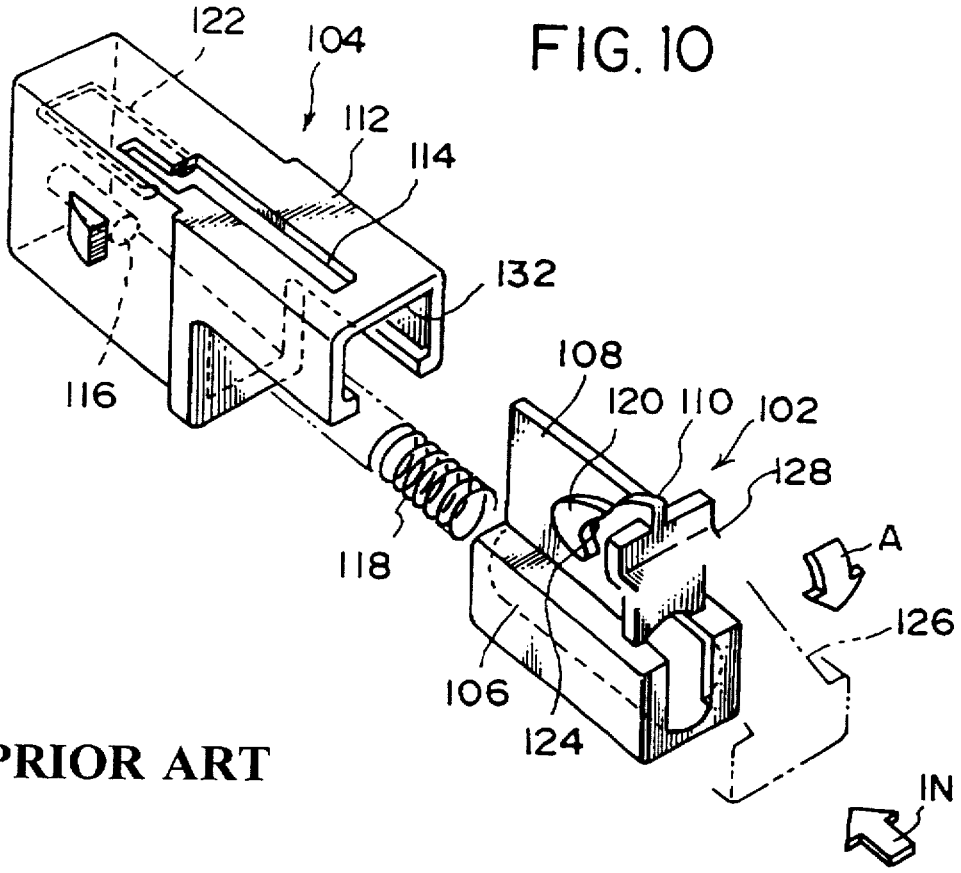
FIG. 10 PRIOR ART
FIG. 10 is an exploded perspective view illustrating a conventional latch device.

As illustrated in FIGS. 2 and 5, the hook 126 is provided via the flexible member 128 at the side of the latch main body 12 opposite the insertion side. The hook 126 inclines freely around the flexible member 128, and the inclination thereof is different at the first position and at the second position of the latch main body 12. The latch device is provided on a main body 150 of an audio device or the like, and a striker 70 which corresponds to the hook 126 is provided at a cover. When the cover is to be closed, if the latch main body 12 is pushed-in from the second position via the pushed portion 130 of the hook 126, the hook 126 is pushed by an insertion opening end 72 of the case 14 and the inclination thereof changes so that the hook 126 may enter into the case 14 (i.e., the hook 126 inclines in the direction of arrow A, and moves from the state of FIG. 5 to that of FIG. 6). The reaching portion 134 which reaches the end portion of the coil spring 30 projects from the pushed portion 130 of the hook 126. The hook 126 receives rotational urging force (in the direction opposite to the direction of arrow A) due to the urging force of the coil spring 30. When the latch main body 12 is held at the first position, the striker 70 engages the interior of the concave portion 136 of the hook 126, and this engaged state is maintained. If the cover is pushed, the latch main body 12 is pushed-in via the pushed portion 130 of the hook 126, the holding of the first position is cancelled, and the latch main body 12 moves to the second position. As the latch main body 12 moves to the second position, the hook 126 urged by the coil spring 30 is returned and tilted. In the second position, the engagement of the concave portion 136 of the hook 126 and the striker 70 is cancelled, and the cover can be opened.

Further, the transverse direction central line B of the case 14 is the side edge line of the guide hole 26, and the guide hole 26 is formed at one side of the central portion. The transverse direction central line C of the latch main body 12 (which corresponds to the transverse direction central line of the case 14) corresponds to the central line D of the side edge portion 20 in the direction of thickness of the plate-shaped portion 18. The stopper 22 is disposed at one side of the central line D. Of the surfaces formed by dividing the side edge portion 20 along the thickness direction central line D thereof, the surface at which the stopper 22 is not disposed forms an abutting portion 74 (illustrated by the mesh pattern in the figure) which extends from the side of the stopper 22 to the latch main body insertion side. The abutting portion 74 misses (does not correspond to) the guide hole 26 and abuts the inner surface of the case wall 24 along the side edge of the guide hole 26.

In accordance with the above-described structure, by pushing the latch main body 12 into the case 14 in the insertion direction, the latch main body 12 is held at the insertion side first position. By pushing the latch main body 12 in again, the holding of the latch main body 12 at the first position is cancelled, and the latch main body 12 moves to the second position due to the urging force of the coil spring 30. As the latch main body 12 moves to the second position, the stopper 22 moves within the guide hole 26. Due to the stopper 22 abutting one end of the guide hole 26, the second position of the latch main body 12 is held. When the latch main body 12 is again pushed-in, the latch main body 12 moves to the first position, and the first position is held.

When the latch main body 12 is pushed-in and moves to the first position, the abutting portion 74 extending from the side of the stopper 22 to the latch main body insertion side abuts and slides along the inner surface of the case wall 24 at the region at which the abutting portion 74 misses the guide hole 26 (i.e., in a vicinity of the guide hole 26), in the direction in which the stopper 22 fits into the guide hole 26.

Accordingly, when the latch main body 12 moves from the second position to the first position, the plate-shaped portion 18 of the latch main body 12 is prevented from entering into the guide hole 26. Joggling which is caused by the latch main body 12 entering into the guide hole 26 is prevented, and smooth movement of the latch main body 12, i.e., smooth latch operation, is realized.

Because the inclination of the hook 126 is different at the first position and at the second position of the latch main body 12, when the latch main body 12 moves from the second position to the first position, urging force in the direction of the stopper 22 fitting into the guide hole 26 acts on the latch main body 12. The urging force is resisted by the abutting portion 74 abutting the inner surface of the case wall 24. The latch main body 12 is prevented from entering into the guide hole 26, and smoother operation of the latch main body 12 is achieved.

Forming the side edge portion 20 of the plate-shaped portion 18 in a circular-arc shape at the insertion side end portion also results in smoother operation of the latch main body 12.

The present invention is not limited to the above-described embodiment, and various modifications are possible. For example, the operation member, which operates each time the latch main body is pushed-in in the insertion direction and which alternately holds and cancels holding of the latch main body at the insertion side first position, is not limited to the operation member of the above-described embodiment, and any of various means may be used. Further, the present invention is not limited to the structure in which the hook is provided.

Further, in the above description, the latch device is provided at the main body of an audio device or the like, and the striker 70 corresponding to the hook 126 is provided at the cover. However, the present invention is not limited to this structure, and various uses are possible.

Moreover, in the above-described embodiment, the guide hole 26 is off-center with respect to the transverse direction central line B of the case 14, the stopper 22 is off-center with respect to the transverse direction central line C of the latch main body 12, and the abutting portion 74 is provided at the side of the stopper 22. However, the guide hole, the stopper and the abutting portion are not limited to this structure.

As described above, in accordance with the latch device of the present invention, joggling of the latch main body can be prevented, and smooth movement of the latch main body can be realized.

While the embodiment of the present invention as herein disclosed constitutes a preferred form, it is to be understood that other forms might be adopted.

What is claimed is:

1. A latch device comprising;

a case having a case wall;

a main body movable in said case in an insertion direction and in an opposite direction to said insertion direction, said main body having a plate-shaped portion projecting therefrom;

an urging member positioned between and engaging said case and said main body to urge said main body in said opposite direction;

at least one cam on said plate-shaped portion;

an elastically deformable lever mounted to said case to be engaged by said at least one cam and be elastically deformed in response to movement of said main body;

said lever engaging said at least one cam against the action of said urging member to hold said main body when moved in said insertion direction to a first releasable position and releasing engagement with said at least one cam when said main body is moved further in said insertion direction from said first position;

a guide hole in said wall of said case extending parallel to said insertion direction;

a stop fixed to and extending from said plate-shaped portion into said guide hole, said stop moving in said guide hole as said main body moves in said insertion and opposite directions and engaging an end of said guide hole against the action of said urging member in said opposite direction to limit movement of said main body in said opposite direction at a second position of said main body;

said lever, when released from engagement with said at least one cam upon movement of said main body from said first position in said insertion direction, allowing said main body to move to said second position;

a hook pivotally mounted to said main body at an end thereof facing said opposite direction adapted to be engaged by a striker to move said main body in said insertion direction, said hook pivoting in one direction while entering said case as said main body is moved from said second position to said first position and pivoting in a direction opposite to said one direction while exiting said case as said main body is moved from said first position to said second position, pivoting of said hook urging said main body to pivot within said case;

said plate-shaped portion having a configuration at a top thereof adjacent said guide hole sufficiently larger than a width of said guide hole to provide a portion of said plate-shaped portion which is urged into contact with said wall adjacent said guide hole in response to pivoting of said hook and which prevents any part of said plate-shaped portion from entering said guide hole, whereby said plate-shaped portion is substantially prevented from pivoting as said main body moves in said case.

2. A latch device according to claim 1 wherein said plate-shaped portion has an insertion end facing in said insertion direction which is inclined downwardly from said top to said insertion end.

3. A latch device according to claim 2 wherein said inclined portion has a circular-arc shape.

4. A latch device according to claim 2 wherein said plate-shaped portion has an opposite end facing in said opposite direction, said stop being positioned adjacent said opposite end.

5. A latch device according to claim 1 wherein said plate-shaped portion has an insertion end facing in said insertion direction and an opposite end facing in said opposite direction, said guide hole having a width extending from said end thereof for a length corresponding approximately to a distance that said main body moves between its first and second positions, and wherein said stop is positioned adjacent said opposite end, said configuration comprising a thickness of said top of said plate-shaped portion between said insertion end and said stop which is larger than said width of said guide hole; said top of said plate-shaped portion abutting said case adjacent said guide hole, thereby preventing said top of said plate-shaped portion from entering said guide hole and said main body from pivoting as said main body moves in said case.

6. A latch device according to claim 5 wherein said top has an inclined portion adjacent said insertion end inclined downwardly from said top to said insertion end.

7. A latch device according to claim 6 wherein said inclined portion has a circular arc shape.

8. A latch device according to claim 1 wherein said urging member is a coil spring having an insertion end facing in said insertion direction which receives a rod projecting in said case from an end wall of said case in said opposite direction.

9. A latch device according to claim 8 wherein said main body includes a tubular portion which receives an opposite end of said coil spring which faces in said opposite end.

10. A latch device according to claim 1 wherein said at least one case comprises a first case extending from one side of said plate-shaped portion and a second case extending from an opposite side of said plate-shaped position, and wherein said lever is U-shaped having spaced first and second ends, said first end engaging said first case and said second end engaging said second case in said first releasable position of said main body.

* * * * *